United States Patent [19]

Sebardt et al.

[11] 4,184,353

[45] Jan. 22, 1980

[54] ROLLING MILL

[75] Inventors: Carl Sebärdt, Stjarnhov; Bengt Orrling, Luleä, both of Sweden

[73] Assignee: Stiftelsen For Metallurgisk Forskning, Luleä, Sweden

[21] Appl. No.: 899,474

[22] Filed: Apr. 24, 1978

[30] Foreign Application Priority Data

Apr. 28, 1977 [SE] Sweden ..... 7704883
Dec. 1, 1977 [SE] Sweden ..... 7713666

[51] Int. Cl.[2] ..... B21B 31/18

[52] U.S. Cl. ..... 72/221; 72/247; 72/249

[58] Field of Search ..... 72/247, 221-223, 72/242

[56] References Cited

U.S. PATENT DOCUMENTS 1,278,616 9/1918 Edwards ..... 72/221
2,213,714 9/1940 Mekeel et al. ..... 72/247
2,767,602 10/1956 Henrickson ..... 72/242

FOREIGN PATENT DOCUMENTS 21208 of 1892 United Kingdom ..... 72/221

*Primary Examiner*—Milton S. Mehr
*Attorney, Agent, or Firm*—Larson, Taylor and Hinds

[57] ABSTRACT

A rolling mill having a roll stand with back-up rolls and two cylindrical work rolls. The work rolls have roll-pass grooves associated in pairs with different roll-pass areas. The driving mechanism of the rolling mill is coupled to the back-up rolls which exercise constant pressure on the work rolls during rolling so that these are in hard mutual contact and rotate with the back-up rolls. The work rolls are axially displaceable in the roll stands between the back-up rolls when the latter are open so that a desired roll-pass groove can be positioned with its center line coinciding with the central plane of the rolling mill.

8 Claims, 3 Drawing Figures

ROLLING MILL

The present invention relates to a rolling mill, especially a 6-roll mill for rolling sections, sheet or strip.

Conventional rolling mills for rolling ingots and sections are usually built as two-high stands, the rolls being relatively long and having long roll-pass groove series through which the products have to pass successively during the rolling process, and conventional mills for cold rolling sheet and strip are usually built up from a series of roll stands in tandem with work rolls through which the products have to pass successively during the rolling process.

The distance between the roll stands in such a two-high rolling mill will be large, while the roller conveyors will be wide and voluminous, and due to the many stands in a mill for cold rolling sheet and strip, large space is required with high plant costs as a result.

The present invention has the object of diminishing the distance between the stands and diminishing the width of the roller conveyors in a hot rolling mill for rolling ingots and sections, and to reduce the number of stands in a cold rolling mill for rolling sheet and strip so that a much less voluminous rolling mill than those known up to now is obtained, the work rolls also being more easily exchangeable than is the case in known rolling mills.

A rolling mill according to the invention is distinguished by a roll stand with back-up rolls and two cylindrical work rolls, the latter having roll-pass grooves associated in pairs, with different roll path areas, with the driving mechanism of the mill being coupled to the back-up rolls, which exert constant pressure on the work rolls during rolling so that these are in hard mutual contact and rotate with the back-up rolls, the work rolls being axially displaceable in the roll stands between the back-up rolls when the latter are open, so that a desired roll path can be positioned at the centre line of the mill to roll a desired contour.

By rolling in the mill according to the invention taking place at the centre line of the mill the whole time, the back-up rolls can be made relatively short and great stability obtained. The length of the back-up rolls and thus the width between the stand side members does not need to be greater than that required by manipulators for handling the rolled product, i.e. reversing and entering the product.

The invention will now be described in detail in the following while referring to the attached drawing on which a rolling mill with two different embodiments of the work rolls according to the invention are schematically illustrated as examples.

Figure 1:
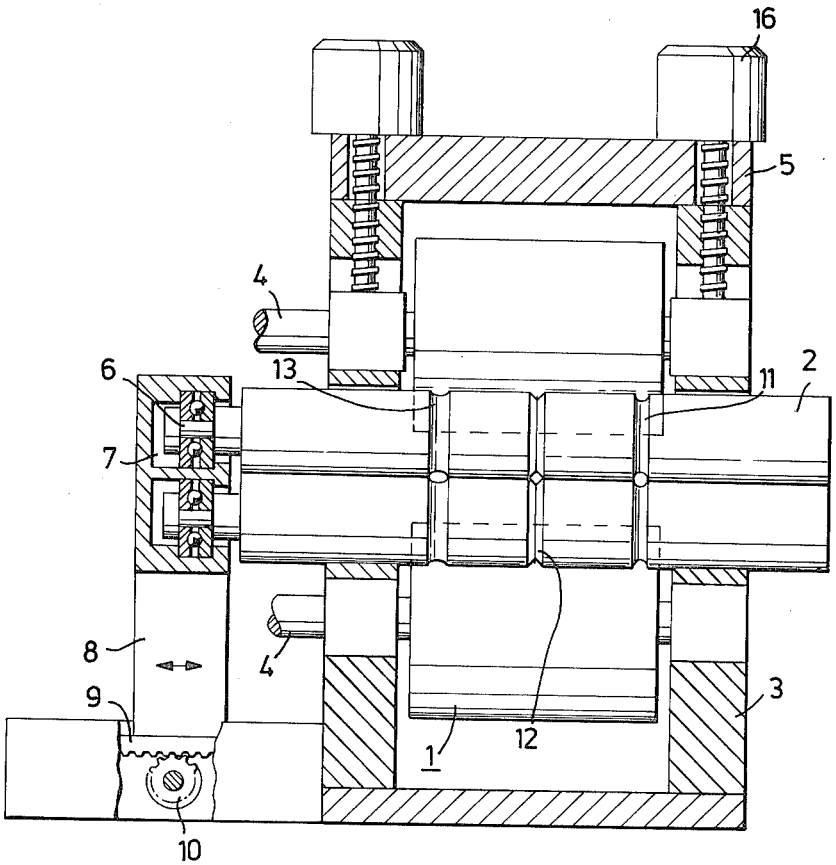
Figure 2:
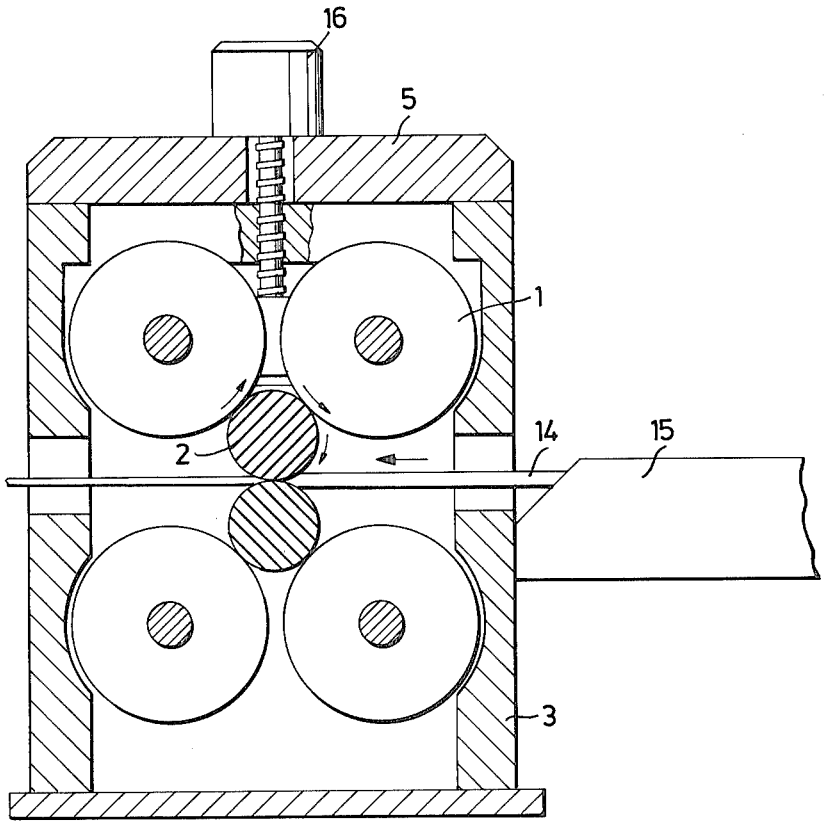
Figure 3:
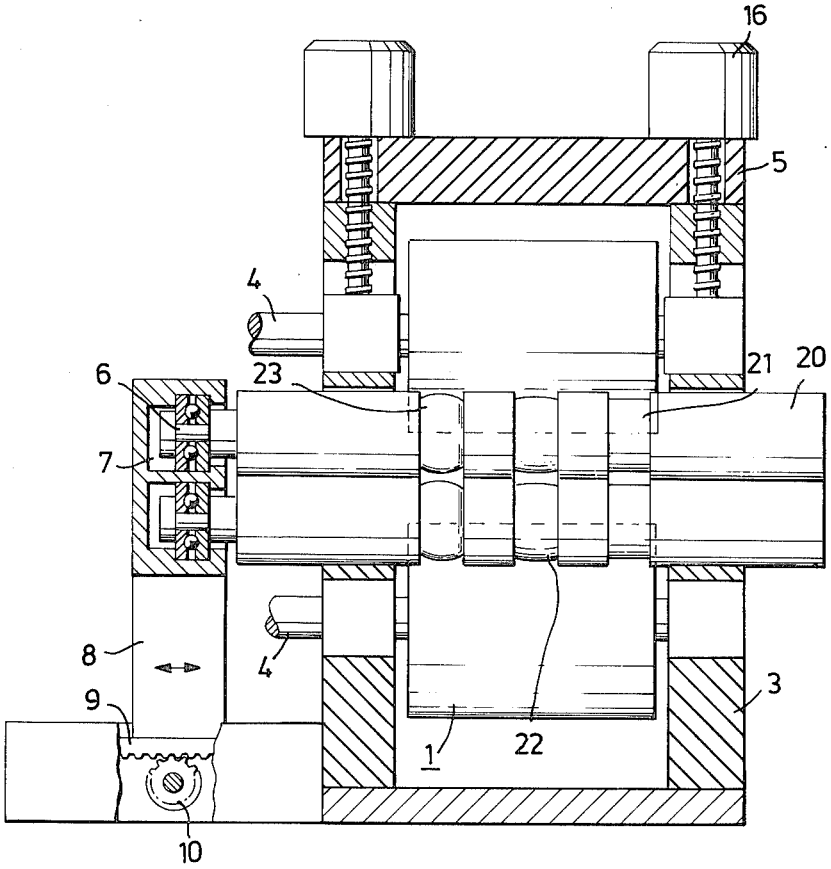

FIG. 1 on the drawing is a partially sectioned front view of a rolling mill according to the invention with work rolls for rolling steel sections, FIG. 2 is a partially sectioned side view of the rolling mill according to FIG. 1, and FIG. 3 is a front view of a rolling mill similar to the one in FIG. 1 but provided with work rolls for rolling sheet or strip.

The rolling mill shown on the drawing includes four back-up rolls 1 mounted in the stand side members 3 and two work rolls 2 in the embodiment according to FIG. 2, and two work rolls 20 in the embodiment according to FIG. 3. The back-up rolls 1 are driven via shafts 4 and can be opened and adjusted by means of the mechanism 5 which can comprise hydraulic cylinders and load screws. During rolling the back-up rolls 1 excercise constant pressure on the work rolls 2 and 20, respectively, so that these rotate with the back-up rolls simultaneously as they are in mutual contact. At one end, the work rolls are provided with axial bearings 6, the bearing houses 7 of which rest in a frame 8 common to both rolls. The frame 8 and thereby the rolls 2 and 20, respectively, are reciprocally displaceable in the stands 3, e.g. by means of a rack 9 operated by a motor driven pinion 10. The motor is actuated by a setting means, so that on a signal from the means it rotates a definite angular distance, thus causing the pinion 10 to be rotated a definite angular distance. The distance moved by the rack 9 and frame 8 and thus the axial position of the rolls 2 and 20, respectively, can thus be predetermined in this simple way, so that the respective roll-pass groove 12,22 required for the pass in question always has its centre line in the same plane as of the rolling mill. In the embodiment according to FIG. 1, the roll-pass grooves have diminishing cross-sectional area from one end of the rolls 2 to their opposite end as indicated by the grooves 11,12,13. As is also indicated, the contours thereof can be different for roll sections which can thus be square, round, oval etc.

In the embodiment according to FIG. 3, the roll-pass grooves have increasing convexity from one end of the rolls 20 to their opposite end as indicated by the roll-pass grooves 21,22,23.

In order to obtain the greatest possible utilization of the rolling path, the roll-pass grooves are arranged as close to each other as in practically possible.

The lateral displacement of the rolls to predetermined positions is provided by a programmable control means via which the motor is actuated to drive the rack 9, mentioned above. A rolling program can thus be preprogrammed with respect to the movement of the roll-pass grooves so that their centre line can coincide with the central plane.

Since rolling always takes place with the rolling path centre line coinciding with the central plane of the rolling mill, or substantially so, the back-up rolls 1 can be made relatively short and the rolling mill will be very stable. The distance between the stand side members 3 is solely determined by the necessary space for ancillary equipment, e.g. a manipulator head with lead roller which automatically provides for reversing and reentry of the ingot or product, on either side of the rolling mill.

Rolling a product 14 is schematically illustrated in FIG. 2, the product running on a roller conveyor 15. For each change of roll path for the product, this taking place in a few seconds with the help of the motor (not shown) and rack 9, the pressure on the back-up rolls 1 is eased, and the work rolls displaced axially by the said programmed distance. The initial position of the back-up rolls can be regulated by simple loading screws 16. Opening and closing the rolls during rolling can take place with the help of short hydraulic cylinders.

Since the product to be rolled always moves in the same line in the longitudinal direction, the ancillary equipment for the rolling mill can be made very simple, e.g. roller conveyors with short rollers, muffle furnaces for keeping hot etc.

A number of work rolls with fitted axial bearings can be kept in a store outside the rolling mill, so that they can be used in the mill as required during a rolling process in progress.

A rolling mill according to the invention can be used for hot rolling as well as for cold rolling of different sections and also for rolling ingots, blanks and wire as well as rolling sheet and strip. It is possible to change from one type of rolling to another by a simple operation solely involving changing the work rollers.

We claim:

1. A rolling mill comprising: a roll stand; a pair of cylindrical work rolls; said work rolls having roll-pass grooves associated in pairs, with different roll-pass areas; means for mounting said work rolls on said roll stand; back-up rolls mounted in said roll stand; driving means for driving said work rolls, said driving means comprising means for rotating said back-up rolls and means for urging said back-up rolls into hard mutual contact with said work rolls such that the work rolls rotate with the back-up rolls; said work roll mounting means comprising means for displacing said pair of work rolls axially in said roll stand such that a desired roll-pass groove can be positioned with its center line substantially coinciding with the central plane of the rolling mill for rolling a desired section.

2. A rolling mill as claimed in claim 1 further comprising means for separating said back-up rolls from said work rolls.

3. A rolling mill as claimed in claim 1 wherein the associated pairs of roll-pass grooves are arranged with successively decreasing roll-pass area.

4. A rolling mill as claimed in claim 1 wherein the associated pairs of roll-pass grooves have varying convexity.

5. A rolling mill as claimed in claim 1 wherein said work roll mounting means comprises a frame supporting bearing members bearing one end of each of said work rolls and means for reciprocally moving the frame with respect to said roll stand for positioning the roll-pass grooves with their center lines substantially coinciding with the central plane of the rolling mill.

6. A rolling mill as claimed in claim 3 wherein said frame moving means comprises a rack and pinion.

7. A rolling mill as claimed in claim 6 further comprising a motor for driving said pinion, and means for controlling said motor, said control means comprising means responsive to actuation of the motor for rotating the pinion a distance corresponding to the distance to a subsequent roll-pass groove.

8. A rolling mill as claimed in claim 1 wherein the work rolls comprise exchangeable pairs of associated rolls with fitted axial bearings which can be inserted into the stand during a rolling process in progress, said roll pairs being kept in a store outside the rolling mill.

* * * * *